US011697551B2

(12) United States Patent
Glickman

(10) Patent No.: US 11,697,551 B2
(45) Date of Patent: Jul. 11, 2023

(54) SHIPPING CONTAINER CONSTRUCTION FASTENING SYSTEM

(71) Applicant: Evan Glickman, Scottsdale, AZ (US)

(72) Inventor: Evan Glickman, Scottsdale, AZ (US)

( * ) Notice: Subject to any disclaimer, the term of this patent is extended or adjusted under 35 U.S.C. 154(b) by 0 days.

(21) Appl. No.: 17/589,823

(22) Filed: Jan. 31, 2022

(65) Prior Publication Data

US 2022/0242661 A1 Aug. 4, 2022

Related U.S. Application Data

(60) Provisional application No. 63/144,373, filed on Feb. 1, 2021.

(51) Int. Cl.
*B65D 90/00* (2006.01)
*B65D 88/00* (2006.01)

(52) U.S. Cl.
CPC ..... *B65D 90/0006* (2013.01); *B65D 88/005* (2013.01)

(58) Field of Classification Search
CPC ..... B65D 90/0006; B65D 88/005
See application file for complete search history.

(56) References Cited

U.S. PATENT DOCUMENTS

2007/0000921 A1 1/2007 Butler et al.

FOREIGN PATENT DOCUMENTS

WO WO-2017141005 A1 * 8/2017 ..... B60P 1/6481

* cited by examiner

*Primary Examiner* — Jason L Vaughan
*Assistant Examiner* — Amanda Kreiling
(74) *Attorney, Agent, or Firm* — Bycer & Marion, PLC; Matthew L. Bycer; Michael B. Marion

(57) ABSTRACT

A bracket system creates a cost-effective way to build large clear spans in shipping container structures. The system efficiently joins four shipping containers along the longitudinal corner edges, with the containers set adjacent one another, to create a compound beam made by combining or coupling both top rails of the two lower containers and bottom rails of the top containers. A single T-bracket mounts onto pre-installed angle brackets on the raised containers, and a fastener is set through the lower plate to the T-bar joining the lower containers. The bracket system may be iterative and used to combine multiple pairs, or single, containers on top of or beside the initial set.

21 Claims, 7 Drawing Sheets

SHIPPING CONTAINER CONSTRUCTION FASTENING SYSTEM

CLAIM OF PRIORITY

The present application includes subject matter disclosed in and claims priority to a provisional application entitled "Metal Construction Fastening System" filed Feb. 1, 2021 and assigned Ser. No. 63/144,373, describing an invention made by the present inventor, herein incorporated by reference.

BACKGROUND OF THE INVENTION

1. Field of the Invention

The present invention relates to buildings furnished from repurposed shipping containers. The present invention more particularly relates to joining multiple shipping containers.

2. Description of Related Prior Art

Utilizing shipping containers in the construction of structures, it is often necessary to cut out large portions of the structural steel skin of the containers to allow creation of larger open interior spaces (beyond the width of the container). When doing so, much of the structural strength of the containers is lost, requiring the clear spans to be reinforced. Often, when cutting out the exterior steel skin, the only remaining structural material is the bottom and top rails. The bottom rail is often an approximately 6" C-channel steel beam (there are multiple specific shapes and sizes, but for all intents and purposes they act similarly to C-channel) and the top rail is may be an approximately 2" square steel tube (there are multiple specific shapes and sizes, but for all intents and purposes they act similarly to bolster the top rail). Neither of these are sufficient to span the types of large open spaces that are typical for bedrooms, living rooms etc. For spans in the approximately 20' range, the bottom rail may be strong enough to support the span, but deflects more than building code would allow. And the top rail the 2" steel tube barely can support itself in that range and is not nearly sufficient for building code.

To combat this, larger spans typically require reinforcement through the addition of large structural beams. Beams can be expensive and create cosmetic issues related to interior ceiling height. An alternate method to remedy this issue is to add webbing joining the top rail of the lower floor with the bottom rail of the top floor. Connecting them together effectively creates a 10"+steel compound beam/truss, which allows the two rails to synergistically combine their strengths create a significant amount of additional rigidity without much additional steel reinforcements.

In practice however, it is difficult to achieve the joint in the field, as the containers get in the way of the joint. With only the first floor stacked (one container high), it is easier to access the mid-span joints from over the top of the containers. When a first second-story container is stacked on to the base container, access to the intercontainer space is still accessible via the roof of the first lower container. However, the fourth container, also stacked over the first story, and all successive containers, effectively make the joint location inaccessible.

A possible solution to this problem would be to cut access holes at every location where a joint to the beams to give on-site workers the ability to access the rails, add the reinforcing steel webbing, and weld or bolt them together.

This solution is time consuming and would likely require expensive on-site engineering oversight. Additionally, for factory-built buildings the holes create a lot of additional complication and reduce the effectiveness of the pre-fab concept to begin with.

Alternative solutions have attempted to solve these structural, building, access, and costs issues. Interior beams or trusses are added to support or buttress a large span. However, efficient beam/truss design requires a larger height of the beam/truss the longer the span. A typical rule of thumb for steel beam design is ½" of height for every 1' of span. For a 20' span, a 10" steel beam may be sufficient. Besides from the cost of adding large steel beams to an interior, there is the larger issue of head room to consider. Typical "High Cube" (AKA Taller) shipping containers are 9'6" tall as measured from the exterior, and 8.9' on the interior. When considering a built-out ceiling and some additional floor height from tile etc., the height is often less than 8.5' tall. A 10" beam would therefore be at ~7.5' mark. Typical residential construction is 9' (lower quality is still minimum 8') and luxury product can be 10' or more. A low 7' high ceiling is not preferred.

Much of the prior art is dedicated to another useful solution of reinforcing the bottom rails of the containers, reinforcement below the entire length of the span joint (potentially the entire length of the container). As the height is limited to ~6", it is not a very efficient use of the additional metal and will not allow one to span very far without significant amounts of material.

Another simple method for adding strength to the span is to simply put in a shim between the stories to allow the top story to rest directly on the bottom. However, if the shim is not secured in place, there is the risk of shifting and negatively impacting the structural integrity. The shims only provide compression to the compound beam created, and do not add tensile strength, and therefore are significantly weaker overall (and do not allow a long clear span).

A very common and classic solution is the installment of interior columns to reduce the loads on the rails. Beyond the negative aesthetic value, the columns occupy space and reduce the usability of the room. More creative solutions have come in the form of adding a spanning structure to the exterior of the containers. The structure can be a normal truss, exterior skeleton, I-beam etc. wherein a shipping container structure is converted into a more conventional structure, with the loss of built-in structural characteristics of the containers. This also requires additional material and labor costs, and much of the work is done on-site.

It is therefore a primary object of the present invention to allow for stacking and joining of multiple containers.

It is another object of the present invention to join multiple spanning bars from adjacent shipping containers into a single effective beam.

It is still another object of the present invention to provide access to fastening system when containers are stacked.

These and other objects of the present invention will become apparent to those skilled in the art as the description thereof proceeds.

SUMMARY OF INVENTION

The present invention is directed to a system for joining containers into a larger structure. One or more raised containers are presenting over and on top of one or more lower base containers. A unitary body fastener may be coupled to an upper longitudinal bar on a base container and a lower longitudinal bar on the raised container. A preferred embodiment has three or four containers so stacked. When four containers are used, tow base containers support two raised containers. The fastener is preferably a T-bracket with a horizontal cap plate and a vertical spine plate. The cap plate preferably mounts onto an extending surface of the lower bar of the raised containers. Preferably the extending plate is affixed to the face of the lower longitudinal bar. A spine of the bracket is preferably fixed by a horizontal, or other fastener, set through the bracket spine and affixed to one or both to the upper longitudinal bars of the base container. This can be a header bar or square bar, or other bars known in the art. Vertical bolts preferably mount the cap of the bracket onto the extending plates. The extending plate is preferably part of an angle bracket. The angle bracket is affixed, and preferably permanently affixed to the raised container. The vertical bolt through the cap plate and/or the structural bolt through the spine may be threaded. A multiple of such fastening systems with multiple brackets may be fixed along sections of the bars to create a multiple joined system.

Contemplated is also a fastening system for joining four adjacent containers, two raised containers positioned above two base containers. A first T-bracket may include a horizontal cap plate and a vertical spine plate. The cap plate preferably mates with a first extending plate fastened to a first lower longitudinal bar of at least a first raised container. At least a first portion of the horizontal cap plate is preferably positioned over the first extending plate, whereby the horizontal cap plate would be coupled to the first extending plate via a first fastener. A second fastener may couple the spine plate to both of the two base containers. This may be coupled to an upper longitudinal bar, header bar, or other position or feature as is known in the art of container structures. A vertical bolt may bind the cap plate to the raised container(s). A horizontal bolt may bind the spine plate to the base containers. A second extending plate may be fastened to a second lower longitudinal bar of a second raised container; wherein at least a second portion of the horizontal cap plate would be positioned over the second extending plate, coupling the horizontal cap plate to the second extending plate via a third fastener. A first angle bracket may be fastened to the first raised container. Preferably, the first angled bracket includes an extending plate, extending from a surface of the raised container, preferably perpendicular and/or horizontal. A second angle bracket may be fastened to the other raised container. Both the extending plates are preferably positioned horizontally whereby the cap plate may be positioned horizontally and above and adjacent, and preferably mating, the extending plates. The spine plate may be positioned vertically and set between the two base containers. Multiple fasters and brackets may be set along the length of the container to further support the joint.

The present invention also includes a method for fastening stacked adjacent containers. Preferably, the containers are positioned such that a first and second base container are set along a ground surface with longitudinal sides set adjacent one another. A third raised container may be positioned on top of at least one of the base containers. A T-bracket may be positioned so that at least a first portion of a cap plate is above and adjacent an extending plate extending horizontally from a face of a raised container. A spine plate may be positioned between (and even adjacent) the base containers or portions thereof. The spine plate may be fastened to the base containers by setting a fastener through a portion of the base containers, such as upper longitudinal bars with the spine plate set intermediate thereof. A hole may be drilled through the spine plate once in position. The cap plate may be fasted to the extending plate(s), whereby the location of vertical bars or fasteners may be noted, and holes drilled into the cap plate and the cap plate set via a second fastener.

In preparing the structure, it is contemplated that larger open areas are preferred. As such, the center or interior walls and sheathing will be removed. For instance, two 40'×8' containers set along one another as base containers will yield an approximate 16' width, as would the raised container level. The center walls removed, access to the lower longitudinal bar is provided. The fourth container emplaced; the two interior walls of the raised container are removed to provide an open space. The angle bracket and/or the shims, and/or the base container upper longitudinal or header bar may be accessed through a hole in the flooring between the two raised containers at the junction therebetween. The T-bracket may be emplaced from above from within the four-container structure into the floor of the raised container(s) and the fasteners applied from above. In one embodiment, the base containers may include a ceiling that is set below the upper longitudinal bar that hides the bar. A header bar may be emplaced at least partially below the ceiling, whereby a lower portion of the emplaced T-bracket spine may set down between adjacent headers in the base containers to allow a single fastener to be emplaced through a first header bar in a first base container, through the spine, and then through a second header bar in a second adjacent base container. A blocking shim may be placed between upper longitudinal bars and/or header bars before and during tightening the horizontal or other structural bolt(s).

BRIEF DESCRIPTION OF THE DRAWINGS

The present invention will be described with greater specificity and clarity with reference to the following drawings, in which.

DETAILED DESCRIPTION OF THE PREFERRED EMBODIMENTS

The structure 1 is preferably composed of repurposed shipping containers. As used herein, the term "repurposed shipping container", as is generally known, refers to twenty-foot and forty-foot shipping containers, and other typical sized containers known in the art of shipping and transportation or repurposed shipping container structures. However, various sized shipping containers of varied lengths, heights, and dimensions may be useful for the present invention. Most notably, these containers include a frame structure, and many include one or more corrugated, or reinforced, sidewalls. Containers also include corrugated or otherwise strengthened roofs, ceilings, and may contain a floor and base floor surface at the bottom of the container. The frame of the containers is often composed of twelve bars spanning the edges and supporting an elongated cubic, or rectangular prism shape. Most containers are shaped with a square vertical planar cross-section shape, and an elongated longitudinal dimension spanning the majority of the length of the container. The longitudinal bars of the frames are often positioned horizontally at the bottom edges and top edges, the length of the containers. As the bottom of containers supports additional weight, many bottoms will be outfitted with a C-bar, or I-beam, as the lower longitudinal bar extending on either side of the container. In applications most suited for the present invention, upper longitudinal bars may be square bars, having a square hollow cross-section. While the upper and lower longitudinal bars are not necessarily fixed at the extreme corners or edges of the containers, the approximate location of the longitudinal bars is useful for understanding of the present invention.

Figure 1:
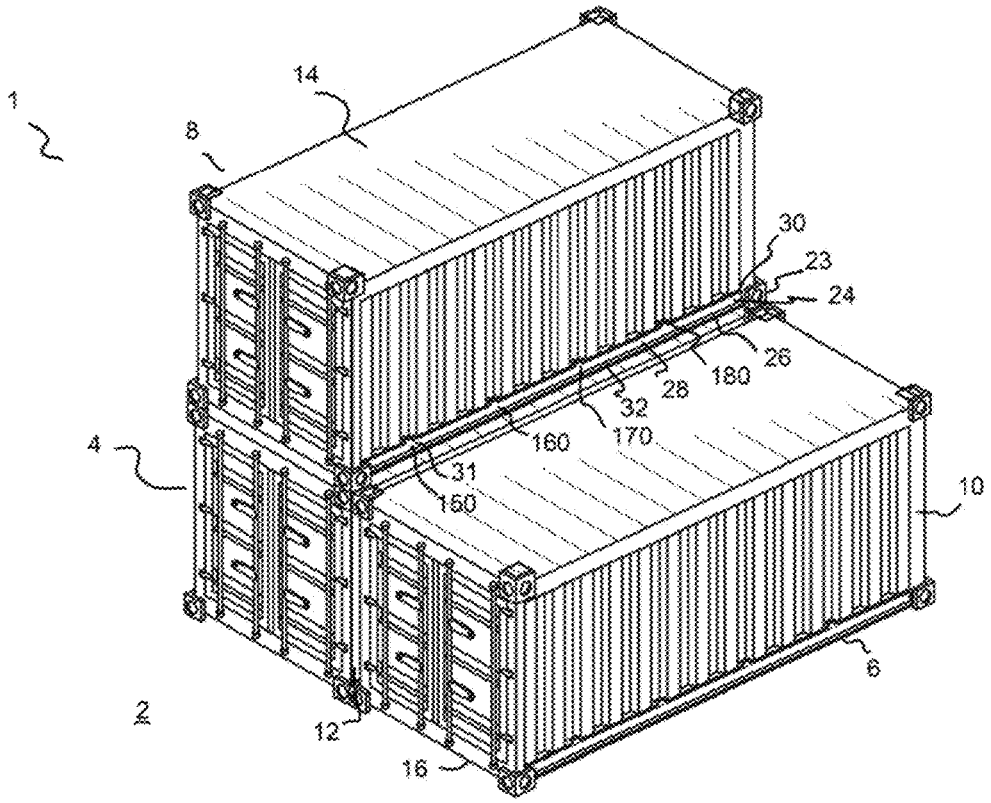
FIG. 1 illustrates a top perspective view of a partially constructed structure with three containers and exposed joint of an embodiment of the present invention.
Figure 2:
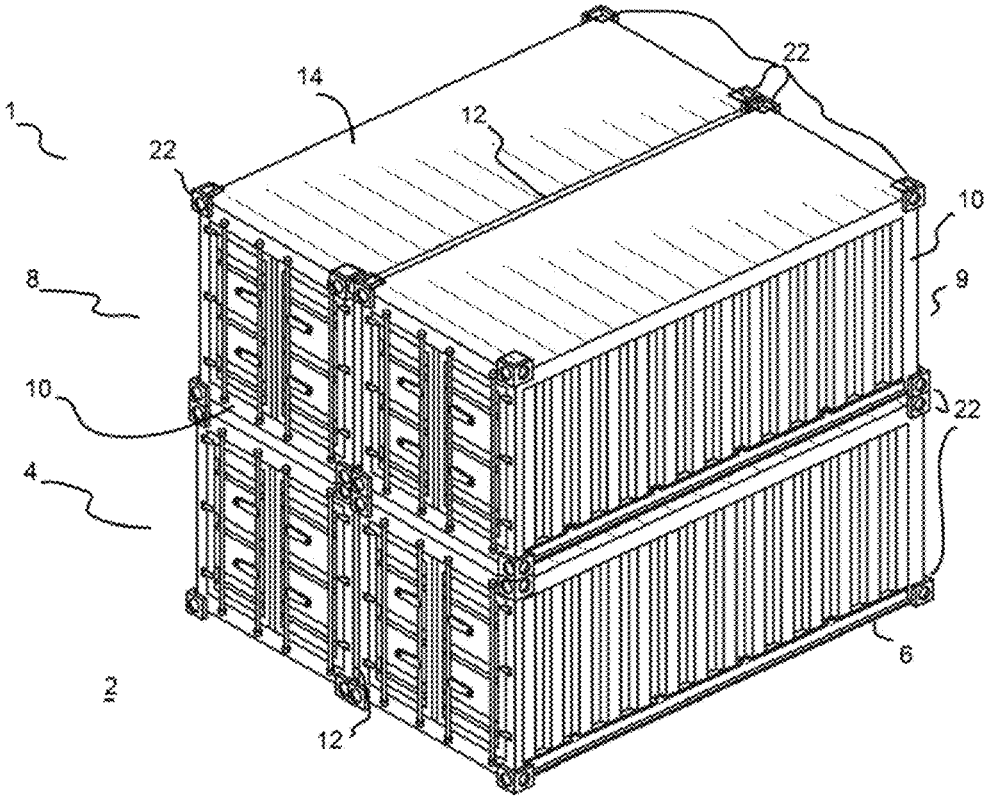
FIG. 2 illustrates a top perspective view of joined structure of an embodiment of the present invention.

As seen in FIGS. 1 and 2, structure 1 is set upon a ground 2, with lower side 16 at least partially resting on the ground surface. Ground 2 is preferably a flat horizontal plane, that may constitute a support surface that may or may not include a prefabricated foundation. As used herein, the terms "horizontal" and "vertical" are used primarily for an understanding of the position, location, and direction of various features. Deviations from horizontal, and vertical, may extend to plus or minus five degrees, and in extreme cases, up to thirty degrees from straight, horizontal, or vertical.

It is contemplated that at least two base containers provide the first story of structure 1. Base container 4 is set on the left side, while base container 6 is set on the right side, with base containers 4 and 6 positioned adjacent one another along the longitudinal sides so that the lower longitudinal edge of base container 4 is set along the lower longitudinal bar of base container 6, and the upper longitudinal bars are similarly set adjacent one another. Insofar as the specification is concerned, while the term adjacent may refer to two structures that are in physical contact with one another, the term adjacent may also include two items positioned near one another, either without an intervening structure, or with an intervening structure adapted to mate, contact, or couple with one or both of the two adjacent structures.

At least a first raised container 8 is set above base container 4 to provide a second story for structure 1, forming a top 14. A second raised container 9 may be set upon base container 6 to provide a rectangular or square prism structure. Structure 1 includes exterior sides 10 of the containers 4, 6, 8, and 9, as well as interior sides 12, whereby interior sides of base containers 4 and 6 are set along one another. Interior sides 12 of raised containers 8 and 9 may also be set along one another. As is known in the art, interior sides may be set adjacent or apart one another, based on the structure of the frame and support walls of containers.

Lower rail 23 may include C-bar 24 extended between corners 22, with overhang 30 and lower extension 32. C-bar 24 may include an exposed face 28. Portions of overhang 30 are removed 31, to allow for locating a fastener from above. This is set at predetermined locations in the C-bar to create a periodic or regular webbing with multiple point. For illustrations, only four locations are shown, 150, 160, 170, and 180. In other embodiments more or less fastening points may be used.

Figure 3:
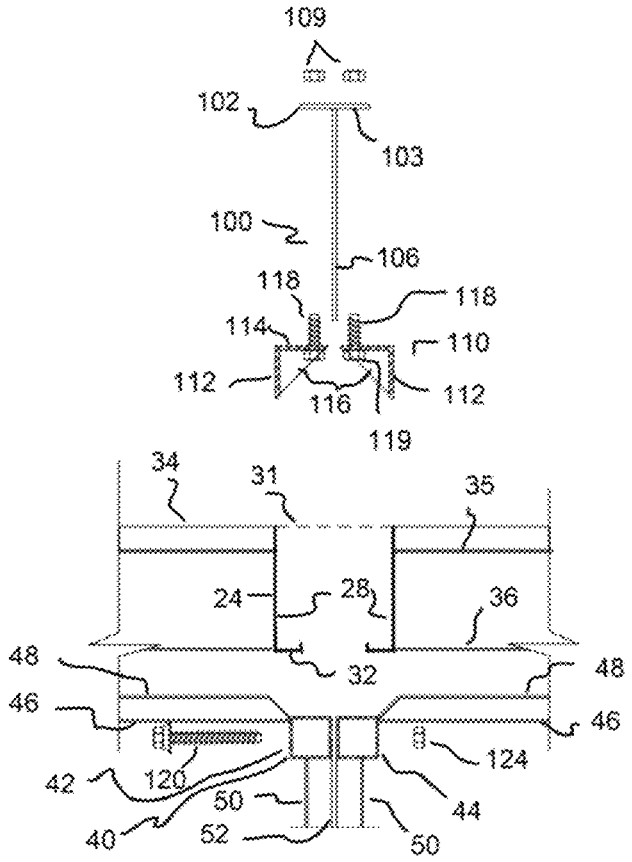
FIG. 3 illustrates a side cross-sectional view of a joint at circle 3-3 of FIG. 1 with fastening system of an embodiment of the present invention in exploded position.

As seen in FIG. 3, a container 17 includes frame structure 18 wherein bars 20 are affixed one another via corners 22. Lower longitudinal bars 23 are preferably set parallel one another. In some embodiments of the present invention, lower longitudinal bars 23 are made from C-bars 24 with the opening of the "C" facing outwards from the structure. C-bars 24 are set along lower longitudinal edges 26. C-bar faces 28 face outwards along lower longitudinal edges 26. C-bar 24 includes a top overhang 30, and a lower extension 32, top overhang 30 and lower extension 32 extending outwards from container. At certain locations, portions of C-bar top overhang 30 are removed, herein referenced as sections 31.

Figure 4:
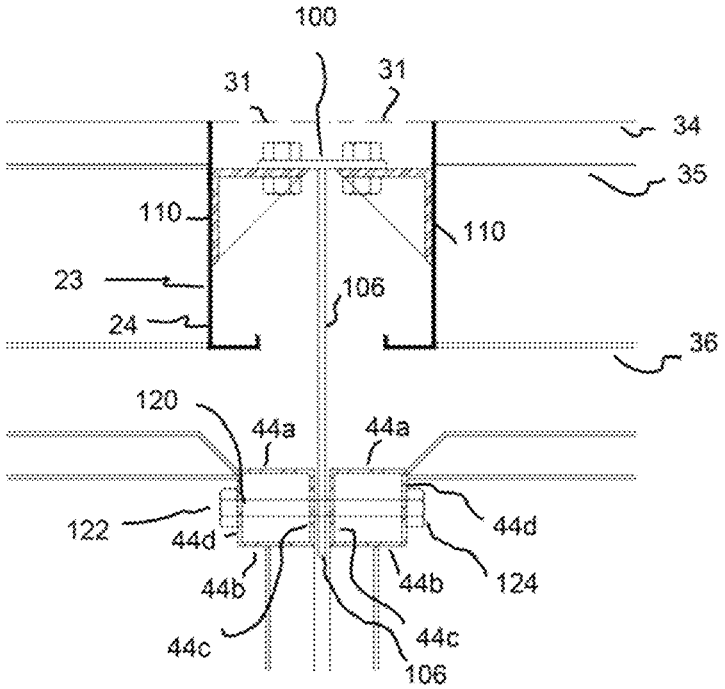
FIG. 4 illustrates a side cross-sectional view of a fastened joint of an embodiment of the present invention in exploded position at circle 3-3.

Container 17 may include a floor surface 34, a floor support surface 35, and a bottom 36, wherein the bottom is the lowest surface of the container and the outward facing structure at the bottom of the container. Container 17 may include upper longitudinal bars 40 set along or near upper longitudinal edges 42. In a preferred embodiment of the present invention, upper longitudinal bars 40 are made of square bars. As shown in FIG. 4, a cross-section of the square bar 44 includes top plate 44A, bottom plate 44B, interior plate 44C, and exterior plate 44D. The top 46 of the container may be made of a corrugated surface with top features 48 set thereon. Top features 48 may simply be a ridged corrugation, or may also be another structure utilized for a separate purpose, such as stacking, lifting, etc. Sidewalls 50 may also include sidewall feature 52 such as a corrugated structure. Structural bolt 120 passes through square bar 44 penetrating interior and exterior side walls 44*c* and 44*d* of upper longitudinal bar 40.

Figure 5:
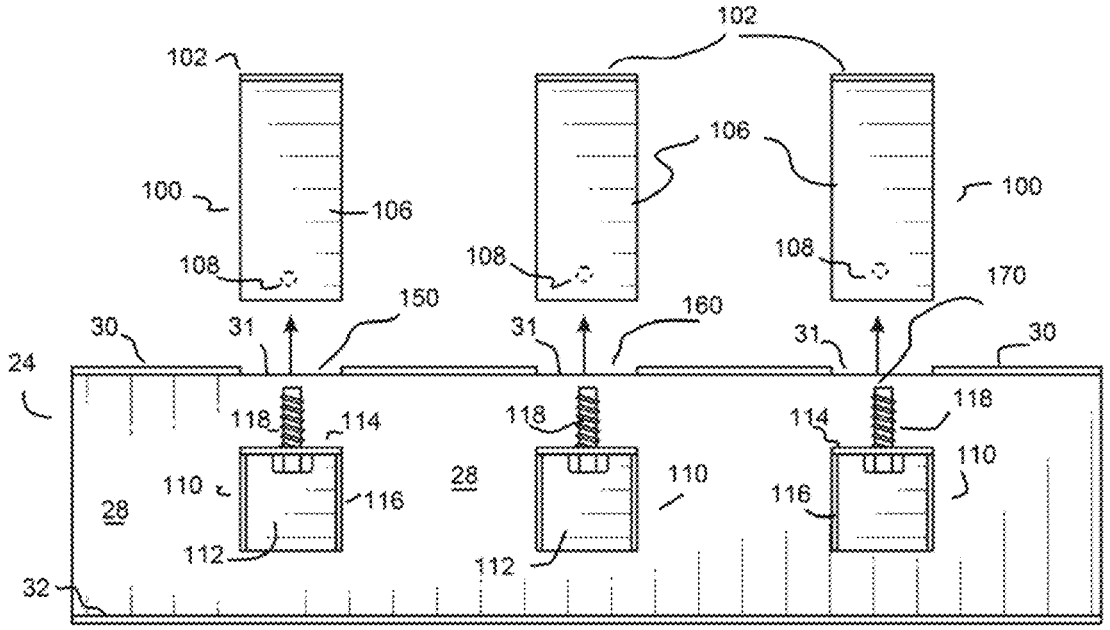
FIG. 5 illustrates a partial side view of a joint of an embodiment of the present invention with fasteners in exploded view.

Referring to FIG. 5, raised containers 8 and 9 are set near one another over base containers 4 and 6. Raised containers 8 and 9 include floor 34, floor support 35, and bottom 36. C-bar 24 is affixed to lower portions or bottom of raised containers. C-bars 24 include a C-bar face, lower extension 32, and removed C-bar top overhang section 31 (shown in dashed lines). Either adjacent or nearby, base containers 4 and 6 include upper longitudinal bars 40, such as square bars 44, set at upper longitudinal edge 42 above sidewall 50 with sidewall features 52.

A T-bracket 100 is shown above floor 34. T-bracket 100 includes cap plate 102, and spine plate 106. It is preferable that T-bracket be made of a single unitary body, preferably of a strong material. Strong materials may include stiff materials, including metals, such as steel and aluminum, or other materials used in the art, or plastics, etc. Angle brackets 110 include joined plates 112, wherein joined plates are adapted to mate with C-bar face 28. In preferred embodiments, joined plates 112 are permanently fixed to C-bar faces, often via welding or integral with the C-bars, or other vertical surface in the lower longitudinal bar. Extending plates 114 serve as a top surface 115 to support lower surface 103 of cap plate 102 thereon. Raised bosses, or shafts, 118, extend upwards, preferably vertical, from extending plate 114. Raised bosses 118 preferably pass-through holes 104 in cap plate 102. Raised boss 118 is preferably threaded to mate with cap nuts 109. Raised boss 118 may be a fixed boss raising from extending plate 114, or simply a threaded bolt as is known in the art. Angle bracket 110, may also include buttress plates 116 that may be set as 45 degrees in order to buttress extending plate via tension removed from extending plate to sidewall of C-bar, or longitudinal bar. Along base containers 4 and 6, upper longitudinal bars 40 may be coupled one another via structural bolt 120 that may pass through interior and exterior plates 44C and 44D of square bar 44. Structural bolt 120 mates with structural bolt nut 124, so that structural bolt head 122 and structural bolt nut 124 fasten next to exterior walls 44D. T-bracket spine plate 106 is set between square bars 44. Square bars 44 must be separated from one another, either in placement or via shims, at least the width 101 of T-bracket spine plate 106. Spine plate 106 includes a spine hole 108 to accommodate structural bolt 120 set therethrough. As shown in FIG. 5, the spine holes 108 are meant to be drilled once T-bracket is set in place, and location of structural bolt 120 is fixed relative spine 106. Preferably structural bolt is set horizontally through upper longitudinal bars and spine.

Figure 6:
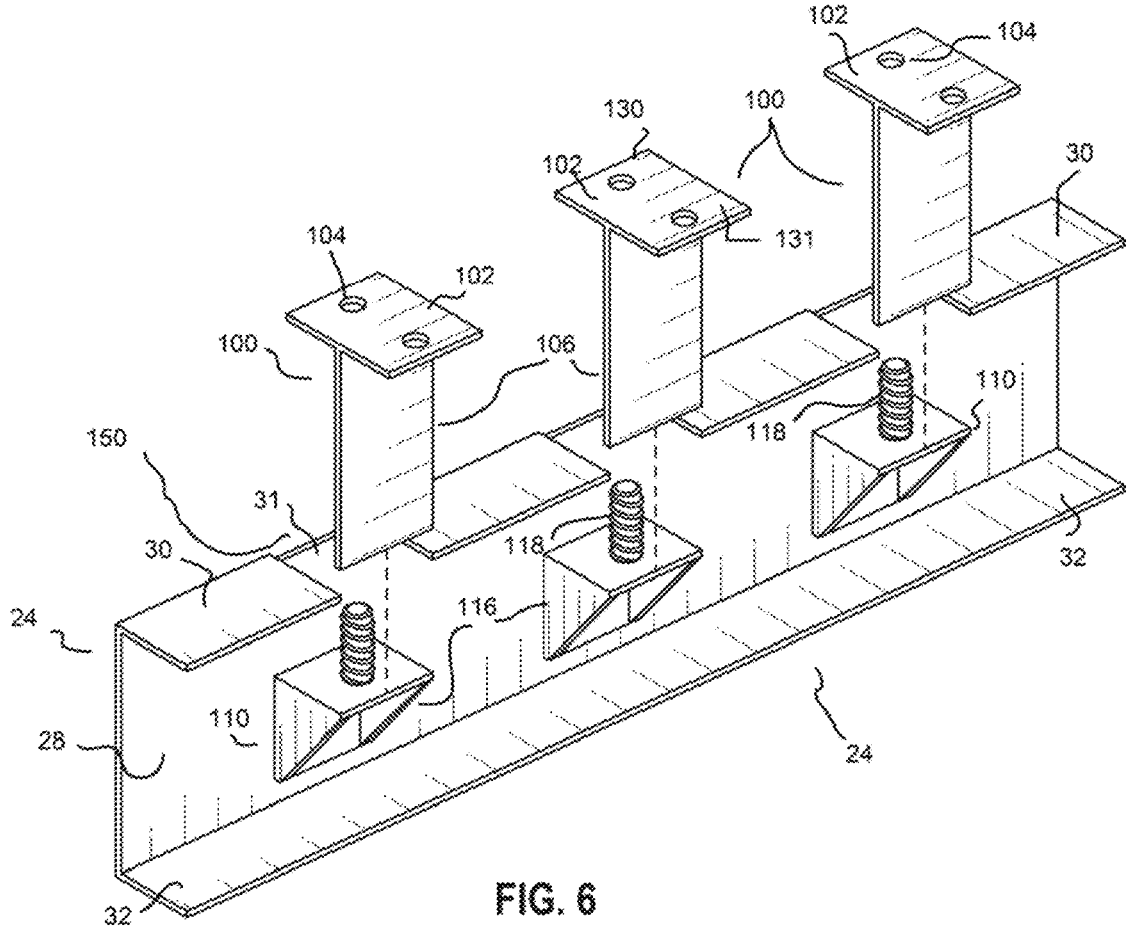
FIG. 6 illustrates a top perspective view of the joint of FIG. 5.

As can be seen in FIG. 6, a side view of the C-bar of a longitudinal bar of one of the raised containers is shown. C-bar 24 includes exposed C-bar face 28. The bottom of C-bar 24 includes lower extension 32. C-bar top overhang 30 may include removed portions 31 so that T-bracket 100 can fit thereover. When attached, removed portion 31 may be refilled as they no longer interfere with T-brackets. Top overhang 30 is removed to allow entry and installment of T-bracket. Angle brackets 110 are fastened to C-bar face 28 with raised boss 118 set above extending plates 114. Cap plate 102 is set over extending plates 114, with cap lower surface 103, at least along a first side of cap plate 130 to mate with top surface 115 of extending plate. It is contemplated that affixing one or more of the T-brackets and the fastening system along the longitudinal edges of the adjoined adjacent containers provides a "webbing", or regular, or periodic joining of the four separate longitudinal bars, so as to make a single structural beam set between at the intersection of the four containers. The extension of the extending plates 114 off the surface of C-bar face 28 provide enough spacing so that spine plate 106 can pass C-bar lower extension 32, and fit between two adjacent C-bar lower extensions and extend below to mate with upper longitudinal bars of the base containers.

The process may be iterative, wherein a fifth and sixth container may be set adjacent the fourth container structure and affixed therein via the same fastening methods to provide for a two-story container with three container width. Similarly, a third story may be affixed on top of the two-story container and affixed thereto in a similar fashion. Once installed, the T-brackets and fastening system provide for a joined four longitudinal bar beam in the structure. Interior sidewalls 12 may be removed, or retained, depending on preference of the interior structure and habitat.

The method for joining these containers is preferably as follows. Two base containers are set adjacent one another, so that the upper longitudinal bars of the two base containers are set parallel and adjacent one another, with at least a distance between the two longitudinal bars for the spine to pass therethrough and bind them. The third raised container is set above one of the two base containers. Because the angled brackets may be pre-affixed to the exterior sidewall of the lower longitudinal bars of the raised containers, and the space for the T-bracket above the angled brackets is also cleared, there is no need to have a set position for the horizontal structural bolts. When the raised container is set upon the base containers, the position of the angled brackets directs the next steps. One can access the angled brackets and drop the T-brackets over the angled brackets and fit the spine plate between the two upper longitudinal bars on the lower base container. One may then drill a hole through the upper longitudinal bars, or square bars, and through the spine plate on location, after the T-bracket is set therein. Once the spine plate is fixed to the upper longitudinal bars of the base containers, the raised boss may be fastened onto the cap plate. Alternatively, the cap holes in the cap plate may be marked and drilled into the cap plate on location to accommodate the raised bosses. If the raised bosses are fixed permanently to the extending plates, the holes in the cap plates have to be specifically positioned, otherwise, the cap plate can be set over the angle bracket extending plate and while adjacent, a bore hole may be drawn through the cap plate and the extending plate on location to allow for entry of a fastening bolt therethrough preferably in a vertical orientation. The T-bracket spine plate may be affixed to the upper longitudinal bars of the base container first with the cap plates affixed to the extending plate on the lower longitudinal bars of the raised containers next.

Once the fourth container is in place, access to the fastening system may be made through a hole in the floor at the joint between the two aligned raised containers, from above. The floor and support are cut through, removed, or not emplaced, exposing the removed overhang bar of the C-bar and the angle brackets emplaced thereon. Thereby, from inside the structure, the T-bracket fastener may be lowered into the hole between the four containers to separate the two raised containers and two base containers. The T-bracket cap may be fastened to the angle bracket and/or extending plate and mated thereto. The raised bosses/shafts from the angle bracket are preferably threaded to allow a cap nut to be emplaced therein, with the cap set between the nuts and extending plate. The bosses may then be trimmed, and the floor finished. From below in the base containers, it is imagined that the T-bracket spine sets between either the upper longitudinal bars, or extends below. The spine can be fixed through the upper longitudinal bars via the structural bolts. If a ceiling has been included in the base container(s), it is preferred that the spine extends below the ceiling. Header bars may be fixed below and parallel the upper longitudinal bars below the ceiling. If necessary, shims may be employed to ensure the lateral space or gap between the containers is wide enough to allow the thickness of the spine plate to fix therebetween. These shims may be set on either or both sides of the T-bracket spine. A blocking shim may be set under the bottom f the T-bracket spine and between the header bars (or longitudinal bars). This blocking shim provides for a lateral separation to provide and maintain tension in the structural bolt to ensure proper friction and the fastener is stable in place. The shims, also ensure that the header bar or longitudinal bars do not bend, dent, or deform under the pressures exerted by the structural bolt(s).

Figure 7:
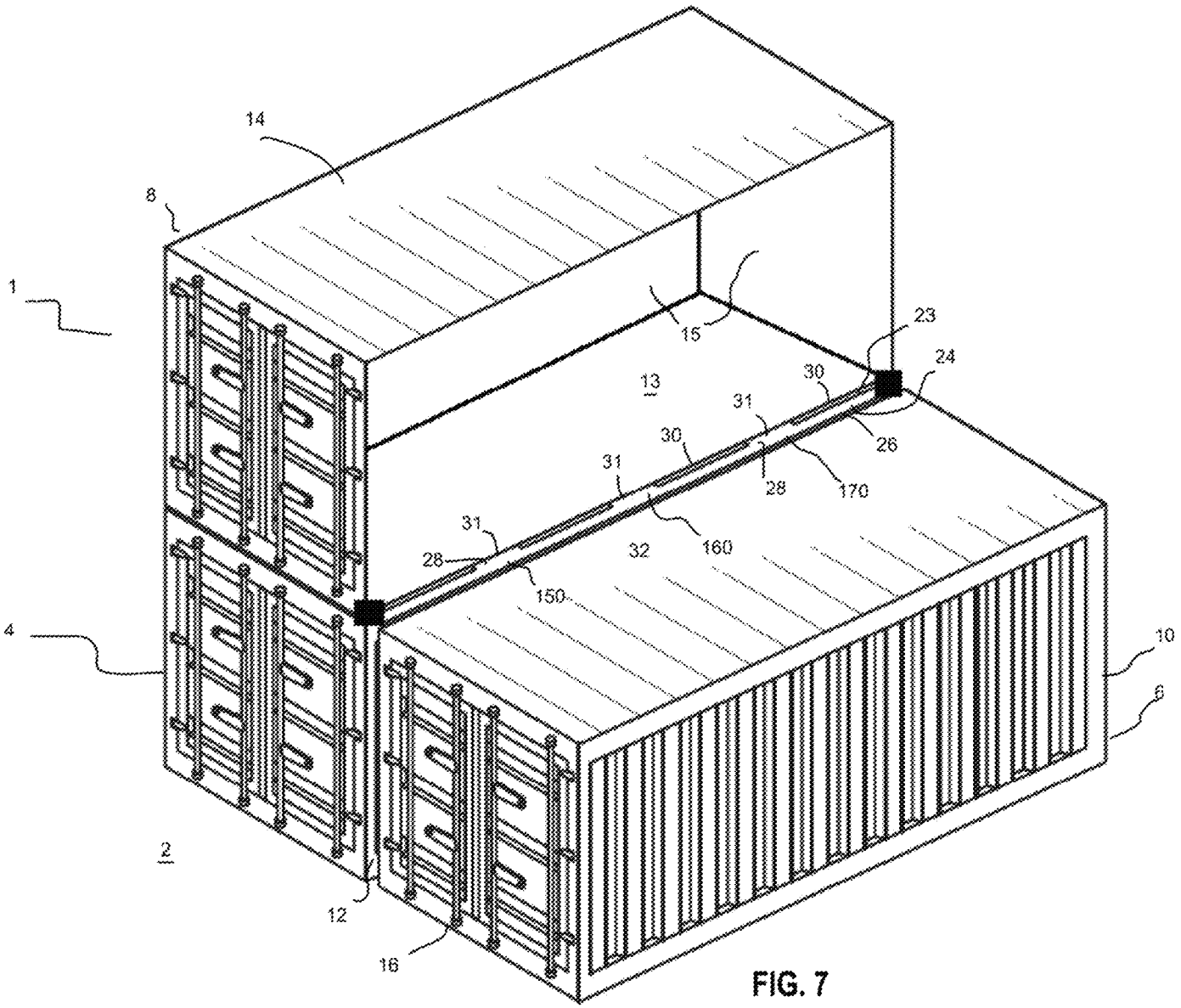
FIG. 7 illustrates a top perspective view of a partially constructed structure with three containers and exposed joint of an embodiment of the present invention.

Referring to FIG. 7, structure 1 with three containers is shown. Raised container 8 is shown forming the top 14 of the structure. Base containers 4 and 6 are set on ground 2, with bottom side 16 resting on ground. Interior sides 12 of aligned or adjacent containers are set next to one another. Preferably, to open up lateral space in the container to make a fourteen-to-sixteen-foot width, the interior walls 12 are removed to provide larger rooms. As shown, lower longitudinal bar 23 is provided in container 8 with C-bar 24 set open along lower longitudinal edge 26. C-bar 24 has exposed face 28 with a top overhang 30 that is cut out at locations 150, 160, and 170 with removed portions 31 of overhang exposing the extending plates (not shown, and other portions of the base containers, or inter container space. One may potentially view the open space in the base containers from above through the overhang removals 31 in floor 13 of raised container. Raised container 8 has floor surface 13 and is bound by interior wall surfaces 15.

Figure 8:
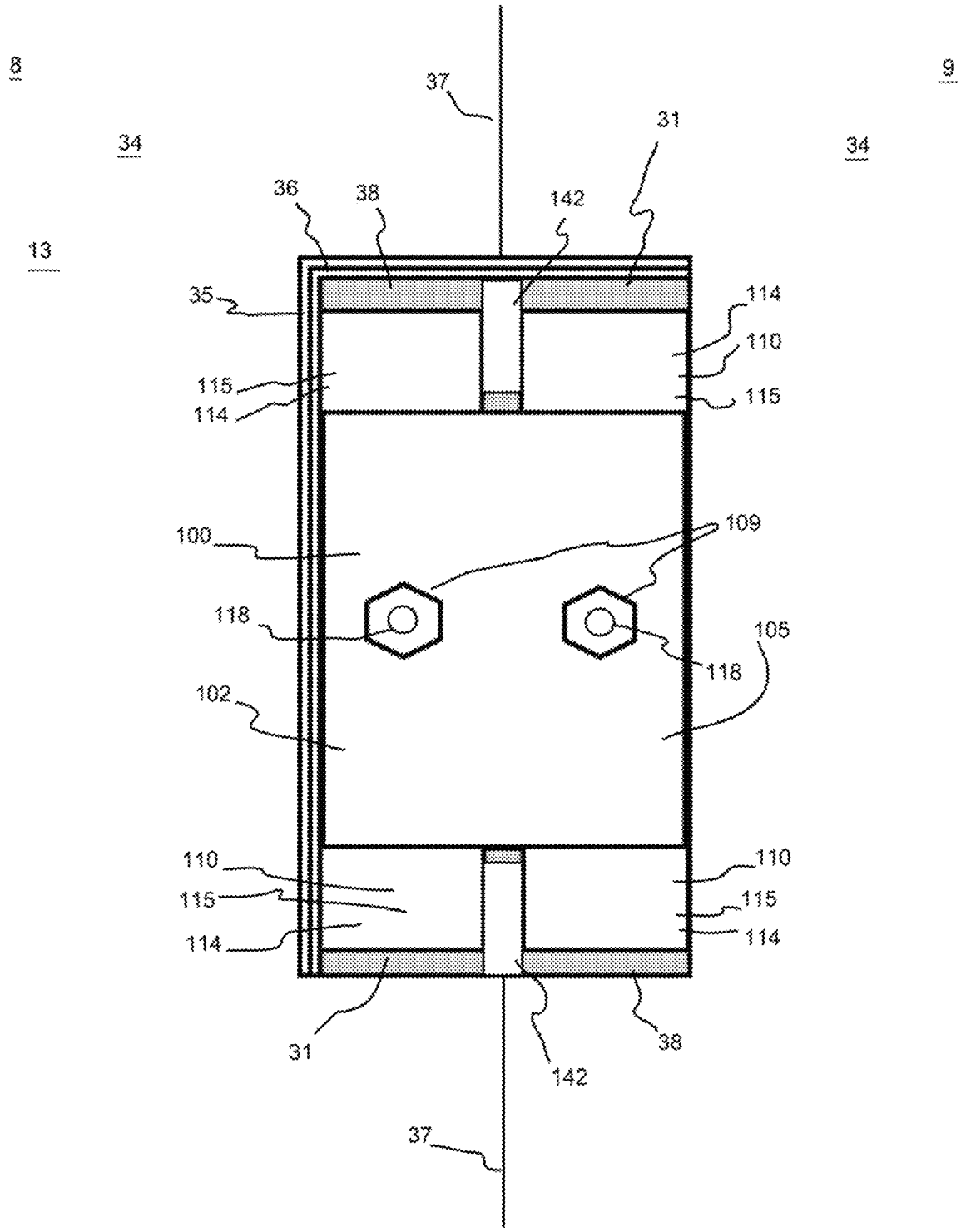
FIG. 8 illustrates a top view of a raised space floor showing an intercontainer joint of the floor of two raised containers with exposed fastener joint.

As shown in FIG. 8, once all four containers are placed together and arranged, raised container 8 and raised container 9 are set side-by-side, mating at mating edge 37. The edge may touch, or be set nearby, such as one or two inches, or even six inches or up to one foot apart. The floor 34 is shown at floor surface 13. The cutout in the floor 34 via removal of overhang 31 of C-bar exposes a space to access fastening system. Below floor 34 is floor support 35, and container bottom 36, and below that is the ceiling 38 or roof of base container(s). Extending plate 114 of angle bracket 110 is exposed in the opening, with the top surface 115 exposed to receive the T-bracket 100 cap plate 102 thereover. Preferably, angle bracket includes bosses 118 extending upwards vertically, whereby the cap plate 102 cap holes receive the bolts/bosses. As T-bracket is lowered into the space between the containers, shims 142 may be used to ensure proper space is available the thickness of the spine plate. Shims 142 may be on either or both sides of the T-bracket (as shown). Once the T-bracket is lowered into position, and the bosses received in the holes, the T-bracket lower surface may rest directly on, or just over the extending plates. Cap nuts 109 fasten the T-bracket cap to the extending plates, and may be set down onto Cap plate top surface. The bolts may then be pared flush. After the T-bracket is emplaced, the upper portion of the fastening system (T-bracket cap onto extending plates of raised lower longitudinal bars) is complete. The lower portion of the fastening system (structural bolt or bolts through the header beams and/or upper longitudinal bars of base containers can then be applied. It is preferred that the holes in the cap are marked and cut on site to match the location of the raises s bolts in the angle brackets. In this manner, tolerances may be allowed, so long as cap plate fits over, and spans, the gap between the extending plates.

Figure 9:
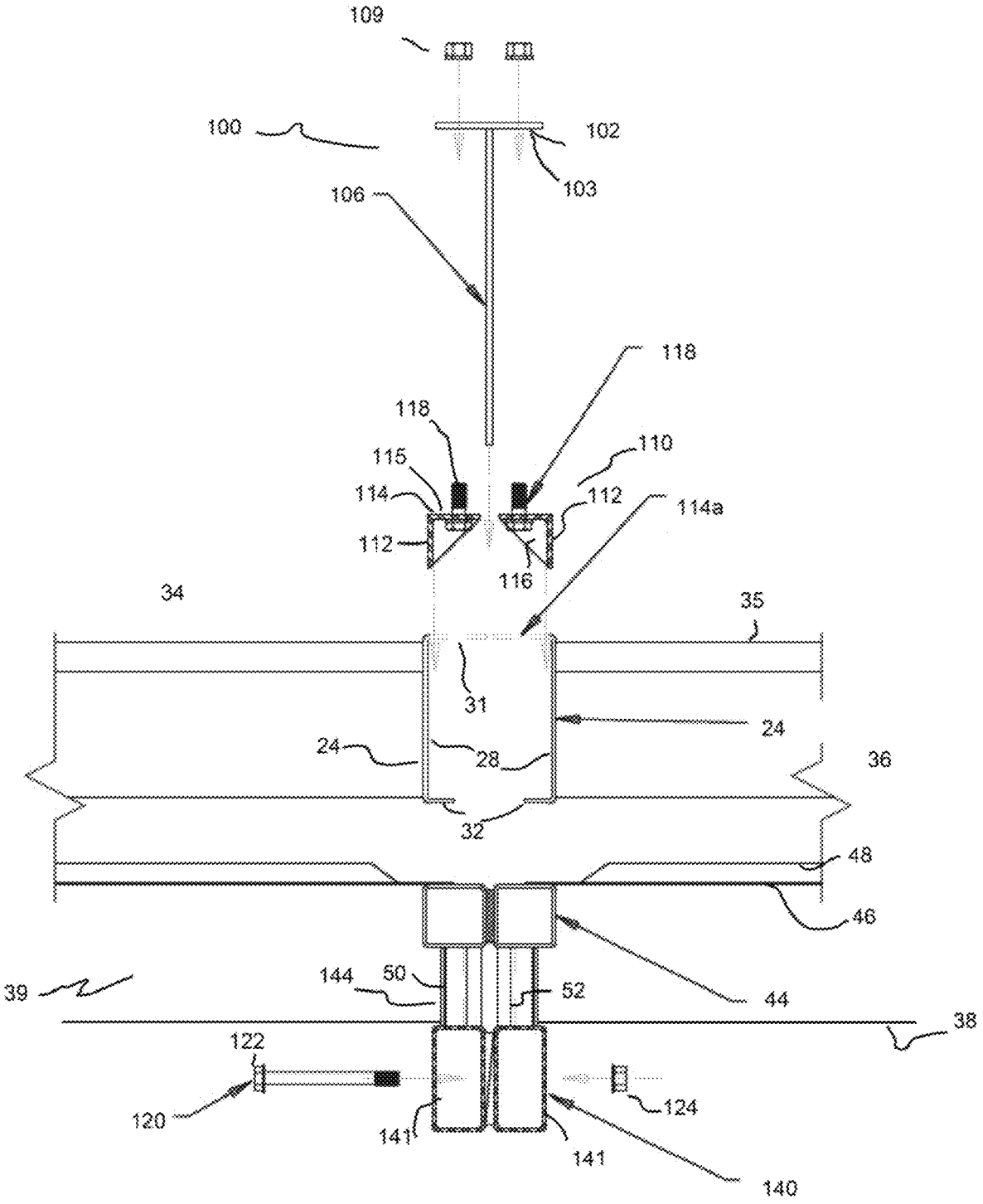
FIG. 9 illustrates an exploded side cross sectional view of an alternative embodiment of the present invention.
Figure 10:
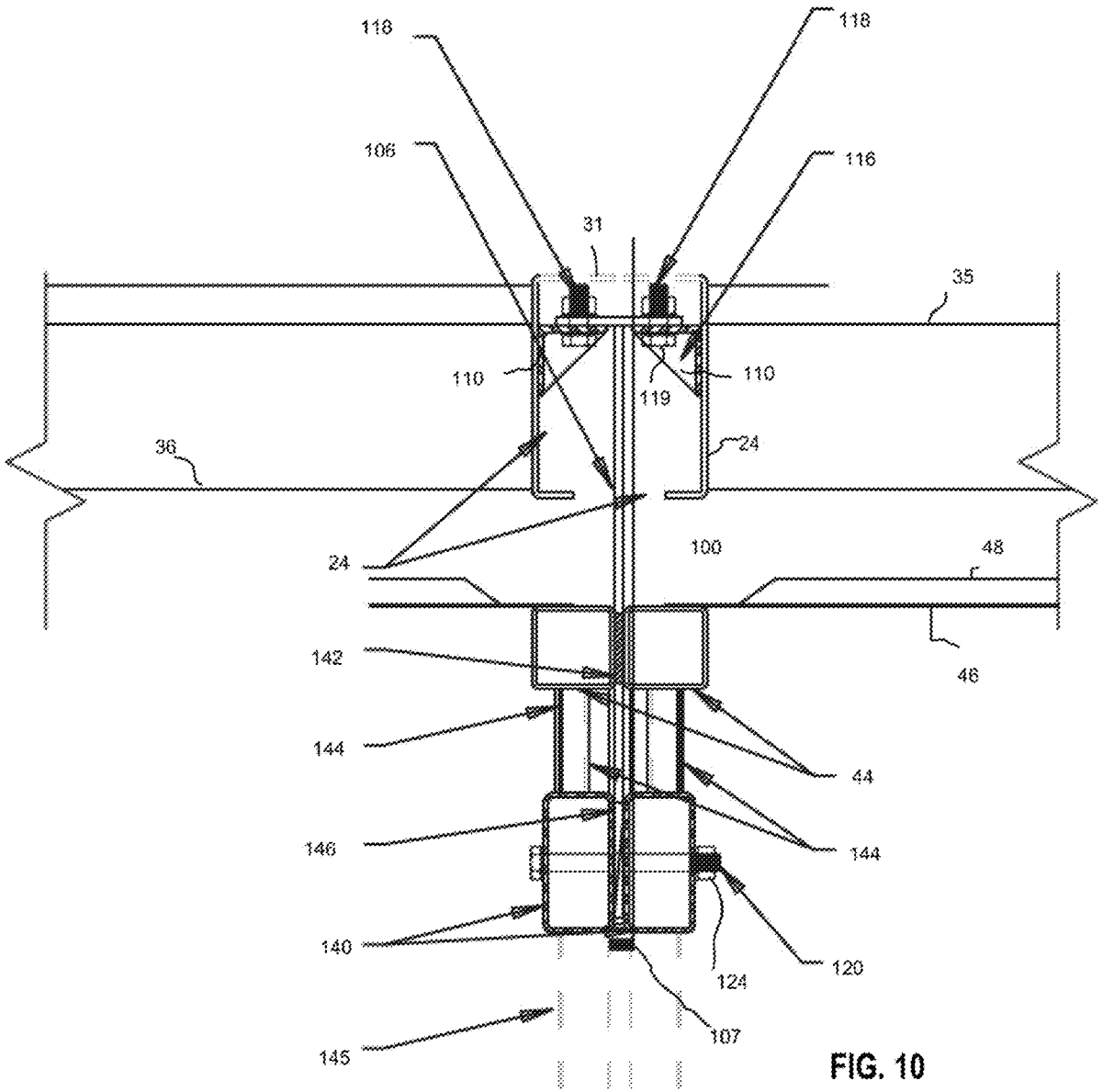
FIG. 10 illustrates a side cross sectional view of the alternative embodiment shown in FIG. 9.

As shown in the cross-sectional view of FIGS. 9-10, the T-bracket 100 is set above (FIG. 9) and emplaced (FIG. 10) into the joint. In this embodiment, bracket 100 spine 106 may extend lower past upper longitudinal bars 44 and pass down to header beam 140. T-bracket 100 would still include the cap plate 102 with lower surface 103 to mate with the extending plate 114 of angle bracket 110 upper surface 115. And angle bracket is still preferably attached to the lower longitudinal bar C-bar 24 face 28, with portions 31 removed from the overhang. Lower extension 32 may still remain. The vertical fasteners 118 may still pass through cap 102 and fastened to cap nuts 109 as fasteners. However, the lower end of spine 106 will pass by the square bars 44 and affixed through header beam 140. Structural bolt 120 may still be used with bolt head 122 mating with the interior surfaces 141 of beams 140, and the structural bolt nut 124 doing likewise with interior surface of header beam 140 on the adjacent or nearby base container. As shown in FIG. 7, the arrows indicate preferred movement of the components to affix the joint, with the bracket lowered into position, the angle brackets either lowered, or prepositioned, and the structural bolts affixing across and through the beams and spine. As shown in FIG. 8, additional components such as shims may be used to position and space the ends of the base containers. An upper shim 142 may be used to space the top rails or square bars 44. Sheathing is known as the walls of the containers. Sheathing 144 may set, and preferably join the top rails 44 with the header bar 140. Further sheathing below 145 may be removed to provide for an open space as between the interiors of the two base containers and make a larger/open room. A lower blocking shim 107 may be set in the space between the header beams to properly space the adjacent or nearby beams of the two base containers.

A ceiling 38 may be set below the longitudinal bars 44, and at least a portion of the header beams 140 extends below, or is exposed below the ceiling 38. It is preferred that the header beam is set below the longitudinal bars to ensure stiffness of the combined compound beam. Hence the remaining sheathing/walls 144 are in place over the header beam. Preferably the sheathing extends about two-to-four inches below the upper longitudinal bar 44. Above the ceiling 38, insulation 39 may be added, and the drop of the header beam allows for enough space to add insulation between the base and raised containers. As the header beam is exposed below the ceiling, the ceiling can be furnished prior to fastening the raised container above. The structural bolt can be affixed after the raised containers are set. The header beam can later be covered for aesthetic purposes.

Header beam 140 may be dropped to make a total of twelve-to-twenty-four-inch height (preferably sixteen to twenty inches) of combined beam. The structural bolt through the header beam may simply be a reinforcement, whereby a first structural bolt sis set between the longitudinal bars 44 and a second one is set below at the header beams, at each (or one or more) of the fastening system locations. The shims 142 and/or 146 provide for a gap between the containers to allow the T-bracket spine plate thickness to fit through. Shims are preferably on either side of the bracket spine. When there are dings or imperfections in the sheathing (walls) or the bars, the shims can be used to mechanically separate the structures enough to fit the bracket therebetween. A blocking shim 107 marries the header beams together and prevents the beams form deforming as the structural bolts is fastened in place. When bolting together the base containers, nut 124 is (preferably threadedly) fastened, pulling the bolt through. The blocking shim maintains the tension, stabilizes the joint, and prevents deformation of the beam upon fastening. The blocking shim is preferably left in pace to maintain the tension, wherein the header beam would be covered or hidden for aesthetic purposes. The blocking shim may be partially below the header beams, or may even be set above and on top of header beans so that a portion fits between the two adjacent header beams.

I claim:

1. A system for joining a first base container, a second base container, and a third raised container and fourth raised upper container, wherein each of the first second and third containers contain structural longitudinal bars; said system comprising:

a. the first base container having a first upper longitudinal bar, the second base container having a second upper longitudinal bar, said first base container positioned adjacent the second base container to position the first upper longitudinal bar along the second upper longitudinal bar;

b. the third raised container having a third lower longitudinal bar, said third raised container positioned over the first base container to position the third lower longitudinal bar along the first upper longitudinal bar; and c. a unitary body fastener coupled to the first upper longitudinal bar, the second upper longitudinal bar, and the third lower longitudinal bar.

2. The system of claim 1 further wherein the fourth raised container having a fourth lower longitudinal bar, said fourth raised container positioned over the second base container to position the fourth lower longitudinal bar along the second upper longitudinal bar; and the unitary body fastener coupled with the fourth lower longitudinal bar.

3. The system of claim 1 wherein said unitary body fastener comprises a T-bracket with a horizontal cap plate and a vertical spine plate.

4. The system of claim 3 wherein said T-bracket is fastened to said first upper longitudinal bar and said second upper longitudinal bar via at least one fastener passing through at least a portion of said first upper longitudinal bar, said spine plate and said second upper longitudinal bar.

5. The system of claim 3 wherein said third lower longitudinal bar is coupled to a horizontal extending plate, said cap plate positioned above said extending plate wherein said cap plate is fastened to said cap plate via a vertical bolt.

6. The system of claim 5 wherein said bolt is permanently affixed to said extending plate and rising vertically upwards from said extending plate.

7. The system of claim 5 wherein said bolt is threaded.

8. The system of claim 5 further comprising an angle bracket fastened to said third lower longitudinal bar, said angle bracket comprising said horizontal extending plate.

9. The system of claim 1 further comprising a second unitary body fastener coupled to the first upper longitudinal bar, the second upper longitudinal bar, and the third lower longitudinal bar, said first unitary body fastener positioned at a first position, and said second unitary body fastener positioned at a second position horizontally removed from said first position.

10. A fastening system for joining four adjacent containers, two raised containers positioned above two base containers, wherein each of the containers comprises an adjacent longitudinal bar along the relative shared corner, said system comprising:

a. a first T-bracket comprising a horizontal cap plate and a vertical spine plate;
b. a first extending plate fastened to a first lower longitudinal bar of at least a first raised container;
c. at least a first portion of the horizontal cap plate positioned over the first extending plate, said horizontal cap plate coupled to said first extending plate via a first fastener;
d. a second fastener coupling said spine plate to both of the two base containers.

11. The fastening system of claim 10 wherein the first fastener comprises a vertical bolt.

12. The fastening system of claim 10 wherein the second fastener comprises a horizontal bolt through upper longitudinal bars of each of the two base containers.

13. The fastening system of claim 10 further comprising a header beam set below the upper longitudinal bars and at least partially below a ceiling of at least one of the two base containers, and further comprising a third fastener attached to the header beam.

14. The fastening system of claim 10 further comprises a second extending plate fastened to a second lower longitudinal bar of a second raised container; and at least a second portion of the horizontal cap plate positioned over the second extending plate, said horizontal cap plate coupled to said second extending plate via a third fastener.

15. The fastening system of claim 14 further comprises a first angle bracket fastened to said first raised container, said first angled bracket comprising said first extending plate; and a second angle bracket fastened to said second raised container, said second angled bracket comprising said second extending plate.

16. The fastening system of claim 15 wherein said first and second extending plates are positioned horizontally; and said cap plate is positioned horizontally and above and adjacent said first and second extending plates.

17. The fastening system of claim 16 wherein said spine plate is positioned vertically, said spine plate positioned adjacent and between the both base containers.

18. The fastening system of claim 14 further comprising a second T-bracket coupling the four adjacent containers, said second T-bracket set at a position offset horizontally from a position of the first T-bracket.

19. A method for fastening stacked adjacent containers with a first and second base container set along a ground surface with longitudinal sides set adjacent one another and a third raised container positioned on top of at least one of the base containers, the base containers each having upper longitudinal bars in parallel one another, the upper longitudinal bars positioned adjacent or near adjacent one another, and the third raised container including a lower longitudinal bar positioned above and parallel at least one of the upper longitudinal bars, said method comprising the steps of:

a. positioning a T-bracket so that at least a first portion of a cap plate of the T-bracket is above and adjacent an extending plate extending horizontally from the lower longitudinal bar;
b. positioning a spine plate of the T-bracket between and adjacent the two upper longitudinal bars;
c. fastening the spine plate to the two upper longitudinal bars by setting a fastener through the upper longitudinal bars and the spine plate; and
d. further fastening the cap plate to the extending plate via a second fastener from above the two base containers.

20. The method of claim 19 further comprising the steps of setting two header beams below each of the two upper longitudinal bars, whereby the header beams are set at least partially below a ceiling of a base container, and further initially fastening the spine plate to the two header beams by setting a fastener through the header beams and the spine plate.

21. The method of claim 20 further comprising the step of positioning a blocking shim at the base or bottom and at least partially between the header beams prior to said step of further initially fastening.

* * * * *